US007669815B2

(12) United States Patent
Clewett

(10) Patent No.: US 7,669,815 B2
(45) Date of Patent: Mar. 2, 2010

(54) DUAL RELEASE LOCKING SYSTEM FOR A SIGN SUPPORTING STAND

(76) Inventor: Stephen W. Clewett, 119 Explorer, Pomona, CA (US) 91768

( * ) Notice: Subject to any disclaimer, the term of this patent is extended or adjusted under 35 U.S.C. 154(b) by 289 days.

(21) Appl. No.: 11/707,838

(22) Filed: Feb. 16, 2007

(65) Prior Publication Data

US 2008/0197252 A1 Aug. 21, 2008

(51) Int. Cl.
*F16M 11/38* (2006.01)
*G09F 15/00* (2006.01)

(52) U.S. Cl. ..... 248/166; 40/610; 40/612; 248/163.1; 248/188.6; 248/624

(58) Field of Classification Search ..... 248/188.2, 248/188.7, 188.6, 166, 170, 168, 163.1, 624, 248/548, 635, 220.21; 40/602, 607.04, 608.16, 40/610, 612
See application file for complete search history.

(56) References Cited

U.S. PATENT DOCUMENTS 4,507,887 A 4/1985 Seely et al.
4,548,379 A 10/1985 Seely et al.
4,593,879 A * 6/1986 Seely et al. ..... 248/624
4,671,479 A 6/1987 Johnson et al.
4,744,536 A 5/1988 Bancalari
4,954,008 A 9/1990 Dicke et al.
5,340,068 A * 8/1994 Sarkisian et al. ..... 248/188.6
5,611,509 A 3/1997 Kulp et al.
5,713,553 A 2/1998 Cooper
6,056,250 A * 5/2000 Hillstrom et al. ..... 248/127
6,315,253 B1 * 11/2001 Dicke et al. ..... 248/188.7
6,626,410 B2 * 9/2003 Marcotte et al. ..... 248/548
6,685,156 B2 * 2/2004 Dicke et al. ..... 248/624
2003/0213888 A1 * 11/2003 Dicke et al. ..... 248/624
2008/0197252 A1 * 8/2008 Clewett ..... 248/220.21

* cited by examiner

*Primary Examiner*—Amy J Sterling
*Assistant Examiner*—Tan Le
(74) *Attorney, Agent, or Firm*—Edwin Tarver; Lauson & Tarver LLP

(57) ABSTRACT

A dual release locking system for locking and unlocking the foldable leg members of a sign supporting stand. For deployment, a locking pin can be retracted by the stepping action of a worker's foot or pulled by hand. Consequently, this same pin can be retracted for retrieval by a kicking action of a worker's foot or pulled by hand.

9 Claims, 10 Drawing Sheets

DUAL RELEASE LOCKING SYSTEM FOR A SIGN SUPPORTING STAND

CROSS-REFERENCE TO RELATED APPPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention pertains generally to the field of portable assemblies such as highway safety signs and light assemblies commonly fitted with pivoting legs to facilitate handing and storage, and more particularly to an adjustable leg system able to accommodate uneven terrain.

Several portable assemblies with pivoting legs have been developed in the art. U.S. Pat. No. 4,954,008 to Dicke discloses a quick release mechanism for locking a tubular leg member of, for example, a mounting base for outdoor signs and barriers. The quick release mechanism includes a lever arm, a pin and a resilient member. The lever arm is pivotally attached to the tubular leg. The pin passes through and extends beyond both sides of the tubular leg and loosely rides within a slot at the operating end of the lever arm. The resilient member fits beneath the handle end of the lever arm being in tensional contact with the outer surface of the leg and the bottom surface of the lever arm. To lock the leg in any position, such as in either the horizontal support position or in the upright compact position, the pin is pushed inwardly to an engaged position in the leg flange by the operating end of the lever arm. The pin is unlocked by pressing on the handle end of the lever arm which pulls the pin out of the engaged position in the leg flange.

U.S. Pat. No. 5,340,068 to Sarkisian discloses a release mechanism for a locking, pivotable leg for an assembly. The release mechanism includes a release pin having an enlarged head and transmission means to transmit movement of the release pin to the locking element moving it from its operative locking position. The transmission means includes a release pin spring shoulder, a locking pin spring groove and a pin slot in the leaf spring disposed to engage these two components. Movement of the release pin causes the release pin spring shoulder to deflect the leaf spring, which deflection is transmitted into movement of the locking pin in turn disengaging the locking pin from the locking pin hole in the base bracket, allowing the leg to pivot freely.

U.S. Pat. No. 5,611,509 to Kulp discloses a quick release mechanism for securing a member to a structure, such as a support leg to a sign stand. The member includes a slot having a bottom surface and the structure has a slot having an open top end. A latch member releasably attaches the member to the structure, and is adapted to extend axially through both the member and structure slots, so that a proximal portion of the latch member extends forwardly of the member slot and a distal portion of the latch member extends rearward into the structure slot. When the latch member proximal portion is actuated downwardly, its distal portion swings upwardly through the open top end of the structure slot, thereby disengaging from the structure slot and releasing the member so that it may pivot relative to the structure.

These systems, when deployed, must be inverted to release the legs for folding and storage. Due to the importance of worker safety, there is a need for a simple and reliable release system that works easily and quickly.

It is therefore an object of the present invention to provide a release system for locking and unlocking the foldable tubular leg members of a portable structure. The release system of the present invention can be operated by users without diverting their attention from their surroundings.

A further object of the invention is to provide a dual release system. For deployment, a lock pin can be retracted by the stepping action of a user's foot or pulled by hand. The same pin can be retracted for retrieval by a kicking action of a worker's foot or pulled by hand.

A further object is to provide a a dual release system that can be reliably operated by a highway worker without diverting attention away from the highway traffic adjacent to the work zone.

A further object is to provide a dual release system that is appropriate for all portable traffic signs and highway lights. These and other objects of the present invention will become better understood with reference to the appended Summary, Description, and Claims.

SUMMARY

The present invention is a dual-release locking mechanism to be used in conjunction with a sign supporting stand. The sign supporting stand comprises a mast and a plurality of upwardly foldable and radially extending legs pivoted at the bottom of the mast. Each leg is incorporated with an individual locking system, which comprises a vertical plate member disposed alongside of the leg, a first locking mechanism for engaging the leg to the plate member at various locking positions as the leg is rotated about the pivot; the first locking mechanism also disengages the leg from a locking position. The locking system further comprises a second locking mechanism for operating the first mechanism wherein the leg can be engaged to the plate member at the various locking positions.

FIGURES—REFERENCE NUMERALS

Figure 1:
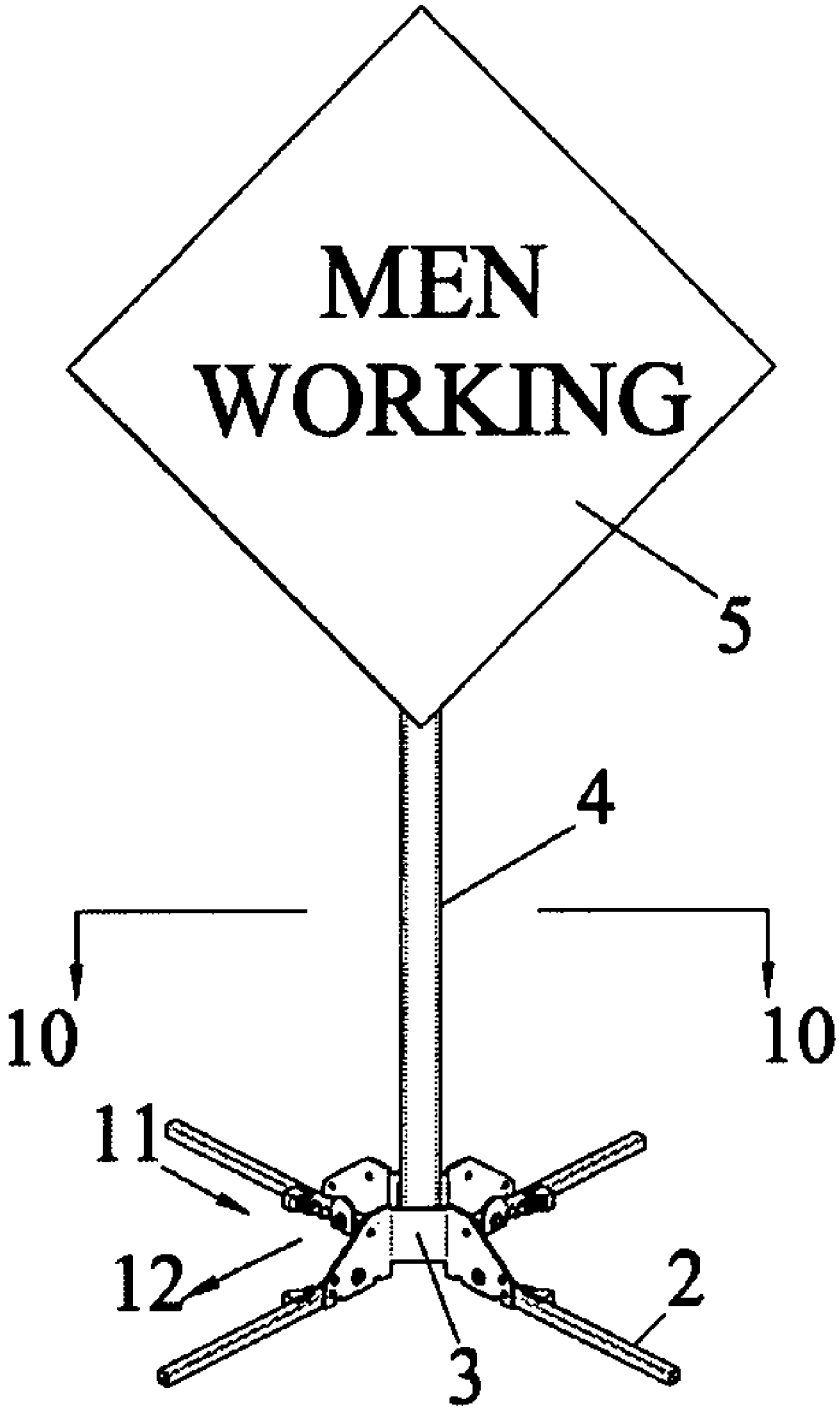
FIG. 1 is a perspective view of the dual release locking system of the present invention in a sign supporting stand, with the legs deployed.

1 . . . Support Stand
2 . . . Leg
3 . . . Base
4 . . . Mast
5 . . . Sign
6 . . . Bolt
7 . . . Head of the Pin
8 . . . Hole
11 . . . Direction of the Kicking Force
12 . . . Direction of the Pulling Force
13 . . . Locking Pin
14 . . . Supporting Block
16 . . . Reaction Boss
21 . . . Compression Spring
22 . . . Ring
23 . . . Disengaging Member
24 . . . Hole in the Leg
25 . . . Sliding wedge-faced member
26 . . . Engaging wedge-faced member
27 . . . Screw
29 . . . Hook
31 . . . Wedge Pin
32 . . . Slot
33 . . . Tension Spring
36 . . . Skirt
37 . . . Guide Edge
42 . . . Plate Assembly
43 . . . Mast Adapter
44 . . . Side Member
60 . . . Elongated Base
62 . . . Shock-absorbing Springs
64 . . . Mast of the Additional Embodiment

DETAILED DESCRIPTION

Referring to the drawings, a preferred embodiment of sign supporting stand is illustrated and generally indicated as 1 in FIGS. 1 through 10. The stand 1 is preferably used for supporting traffic signs and the like. The stand 1 comprises pivotable legs 2 which incorporate a dual-release locking system of the present invention.

Figure 2:
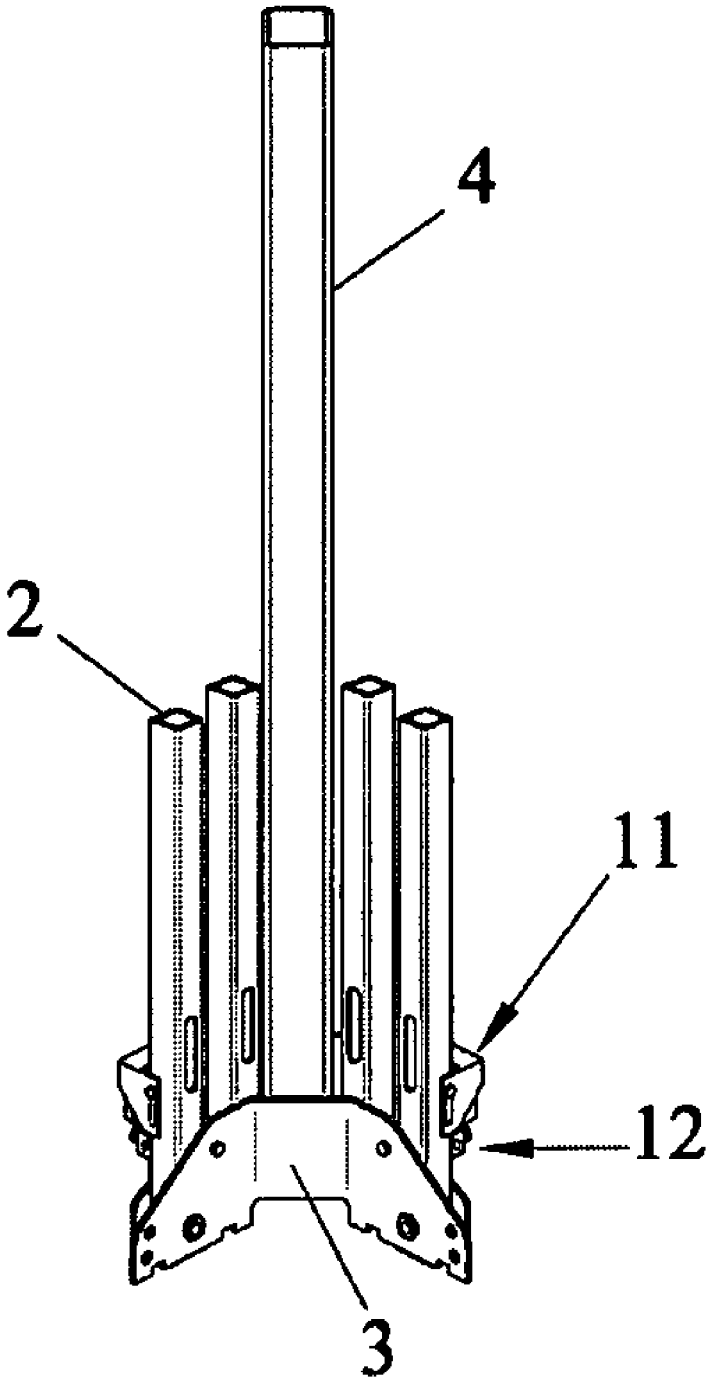
FIG. 2 is a partial perspective view of the dual release locking system of the present invention in a sign supporting stand, with the legs folded and sign moved

Referring to FIGS. 1 and 2, the stand 1 includes a base 3, with legs 2, mast 4, and sign 5. As arrows 11 and 12 show the direction of operation, a leg 2 is released by a user's foot engaging sliding wedge-faced member 25 with a longitudinal kicking action 11 or by hand pulling a locking pin 13 at 12. As shown in FIG. 2, a folded and locked stand 1 is held vertical and its legs 2 released by the sliding wedge-faced member 25 with a vertical steeping action 11 or by hand pulling the pin at 12.

Figure 3:
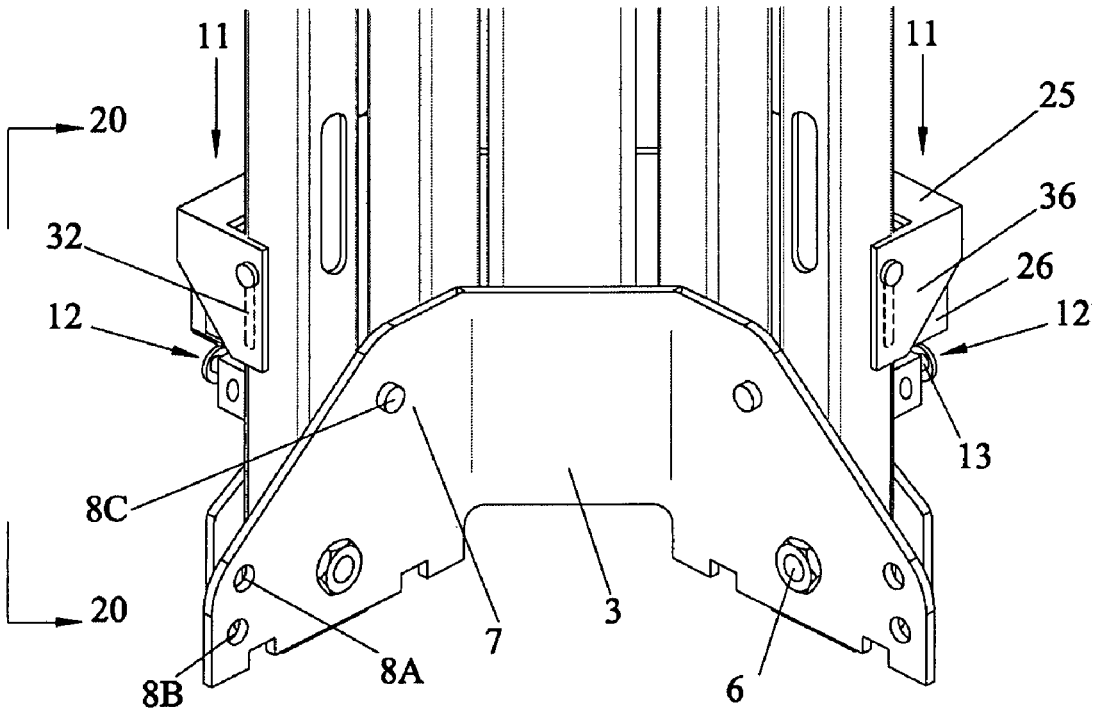
FIG. 3 is an enlarged fragmentary perspective view of the dual release locking system Illustrated in FIG. 2.
Figure 4:
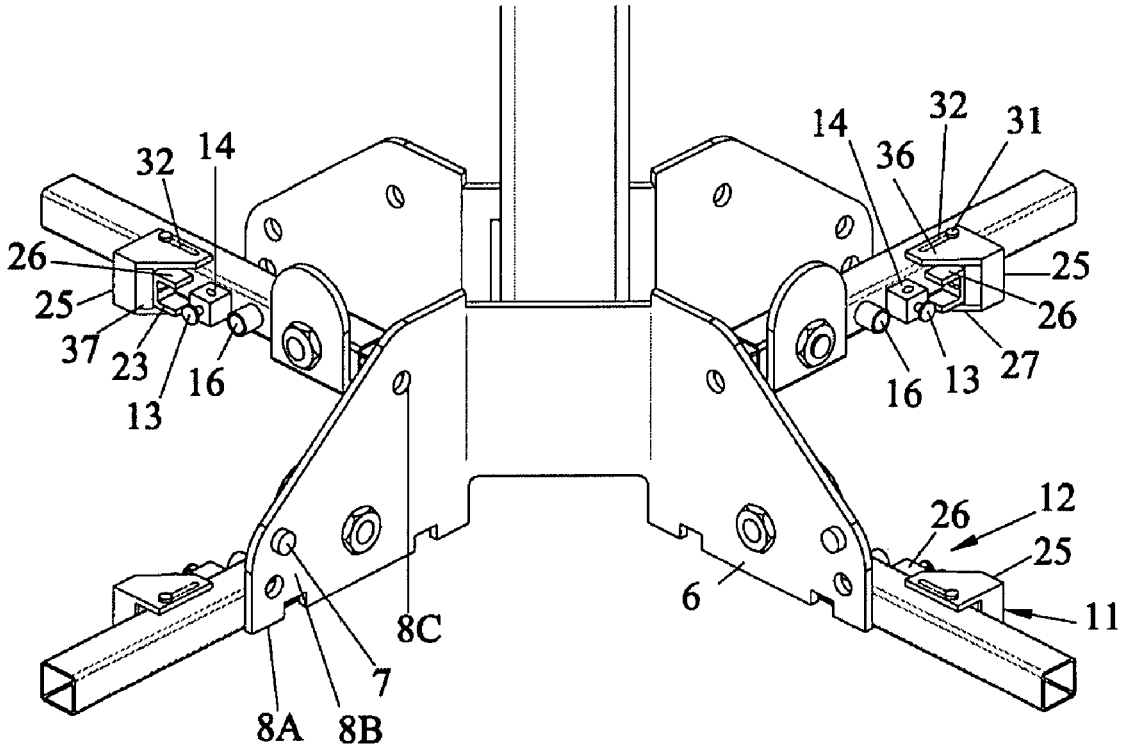
FIG. 4 is an enlarged fragmentary perspective view of the dual release locking system illustrated in FIG. 1.

Enlarged perspective FIG. 3 and FIG. 4 show legs 2 pivoting on bolt 6 through base 3. The head 7 of the pin 13 protrudes through a hole 8*c* to lock leg 2 in a vertical (zero degree) position, for storage as seen in FIG. 3. FIG. 4 shows the legs 2 deployed and locked at 8*a* (90 degrees) for sitting on level ground. For uneven ground the legs 2 are deployed and locked at 8*b* (95 degrees).

Figure 5:
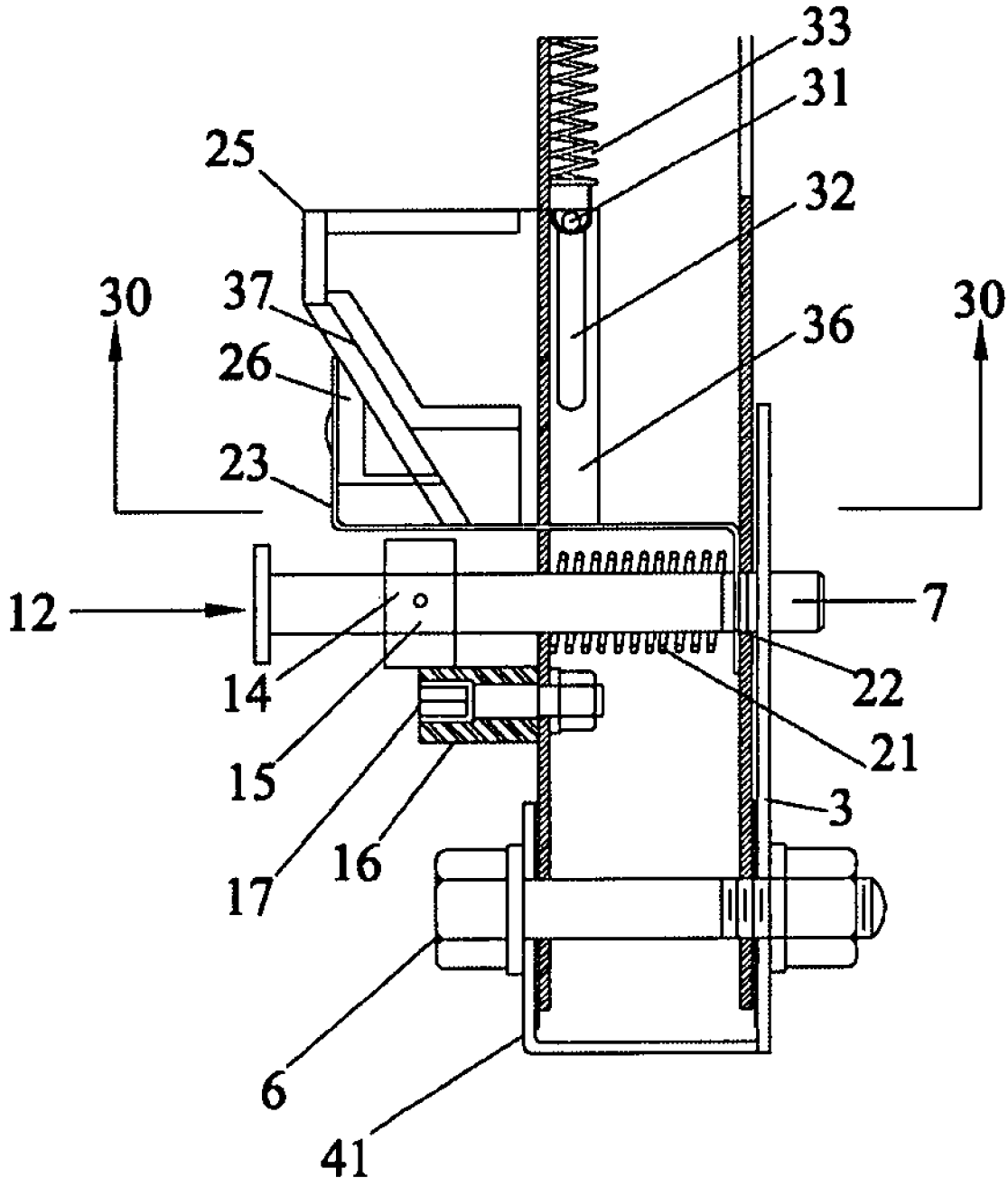
FIG. 5 is an enlarged sectional view taken on line 20-20 of FIG. 3.
Figure 6:
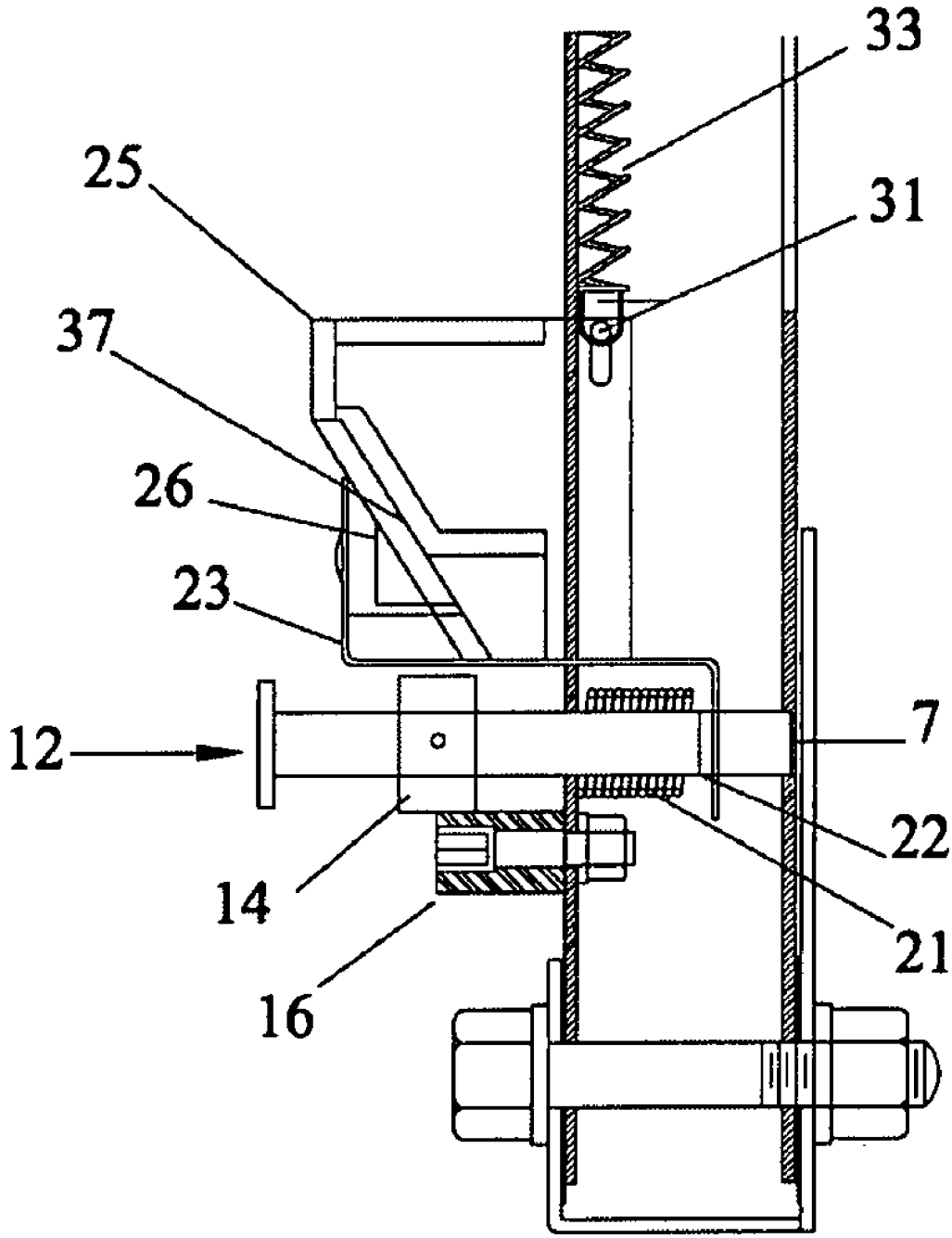
FIG. 6 is an enlarged operated sectional view of the dual release locking system.

A novel feature of this present invention is the sliding wedge-faced member 25 which slides along leg 2 guided by a pair of skirts 36 and retained by a wedge pin 31 which rides in slot 32. The sliding wedge-faced member 25 is pushed at 11 to slip under an engaging wedge-faced member 26 thereby lifting it and consequently the pin 13. Turning to FIG. 5, a sectional view and an operated sectional view FIG. 6 reveals a disengaging member 23 secured to the top of engaging wedge-faced member 26 by screws 27, and extending through a hole 24 in leg 2 to fit under a compression spring 21 and a ring 22 on the pin 13 retracting said pin 13 and its end 7. The sliding wedge-faced member 25 is returned to its original position by a tension spring 33 connected to pin 31 and to hook 29 in the leg 2. Force 11 through the wedges is counteracted by a reaction boss 16 which is secured by a bolt and a nut inside of leg 2. The disengaging member 23 slides and pushes against a supporting block 14 attached to the pin 13. The block 14 in turn slides and pushes against the boss 16 allowing the pin 13 to retract without binding.

Figure 7:
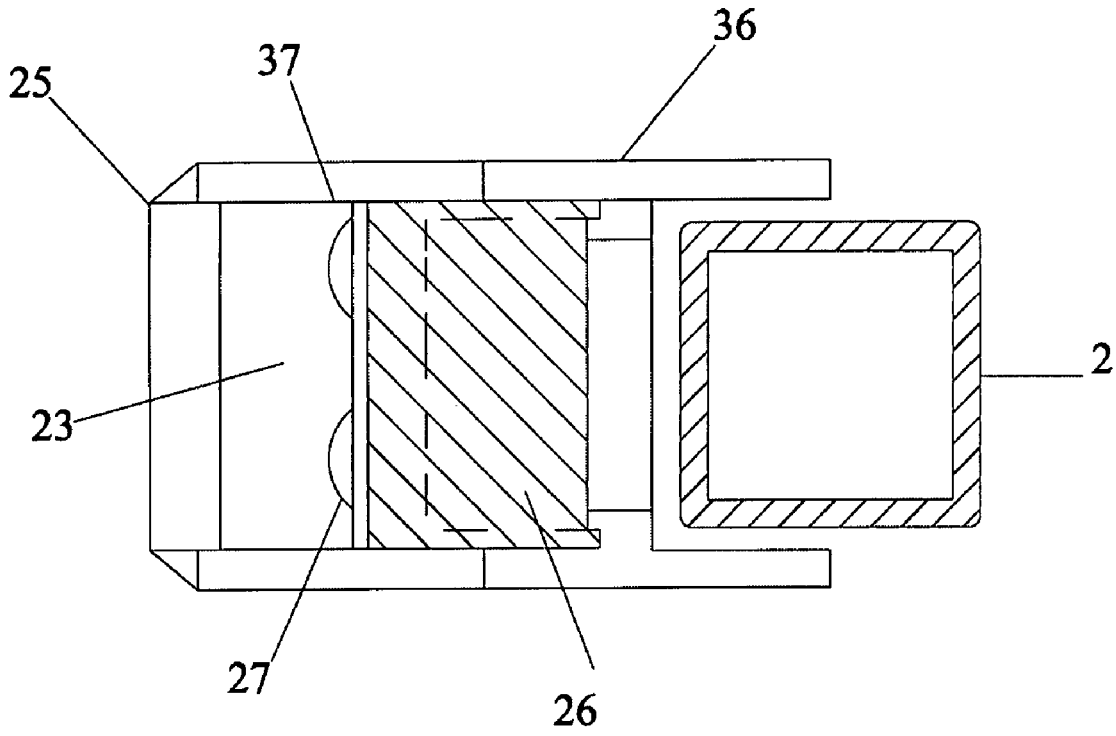
FIG. 7 is an enlarged sectional view taken on line 30-30 of FIG. 5.

Sectional view FIG. 7 clearly shows the guide skirts 36 on the sliding wedge-faced member 25 beside leg 2. The sliding wedge-faced member 25 has on its front face guide edges 37 to center and guide the engaging wedge-faced member 26.

Figure 8:
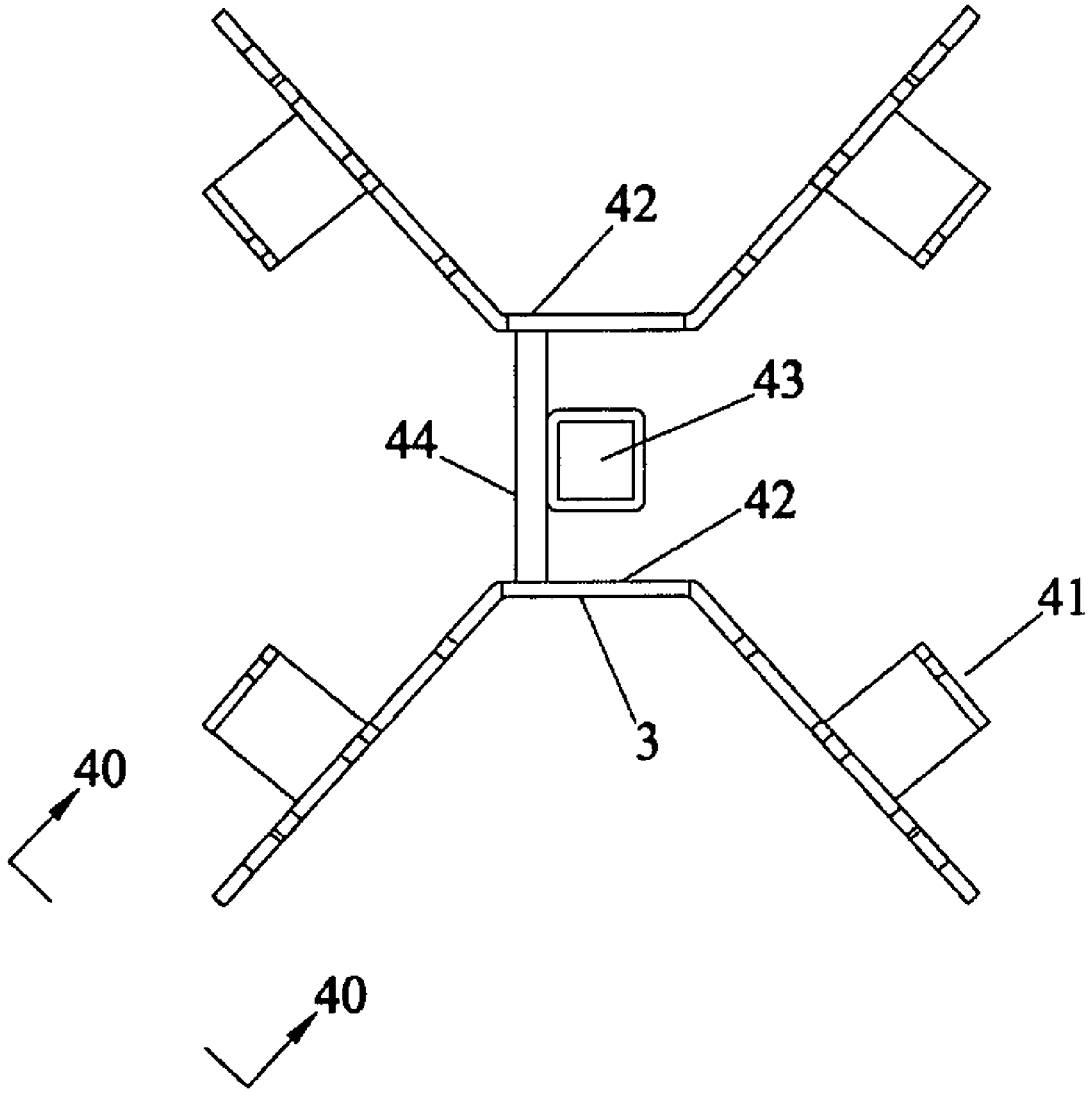
FIG. 8 is an enlarged partial sectional view taken on line 10-10 of FIG. 1.
Figure 9:
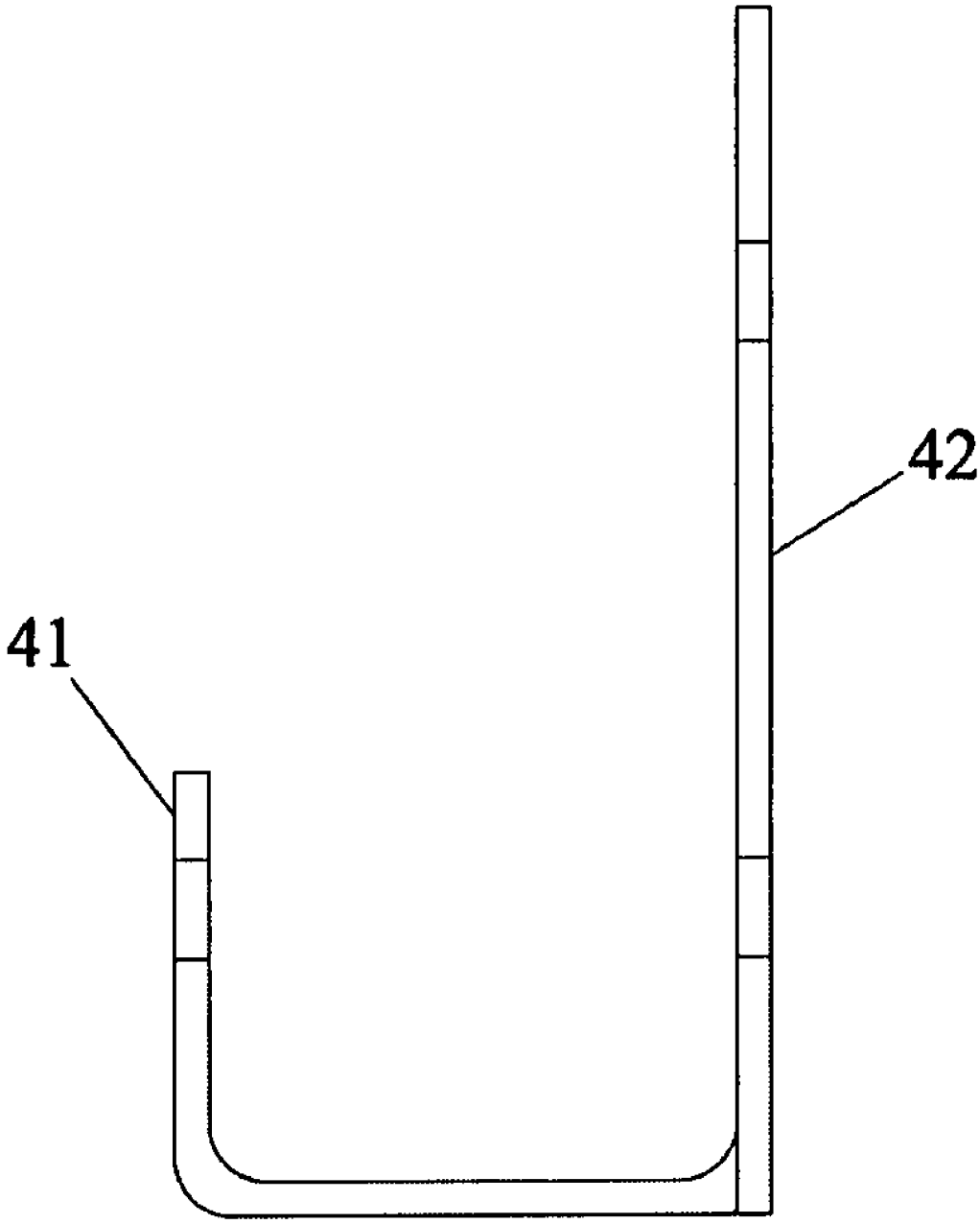
FIG. 9 is an enlarged partial sectional view taken on line 40-40 of FIG. 8.

FIGS. 8 and 9 show another novel feature of the present invention which is the one piece plate assembly 42 of base 3. This plate assembly 42 is cut and formed to extend as an integral front lip. A mast adapter 43 and a side member 44 are welded between two side plates 42.

Figure 10:
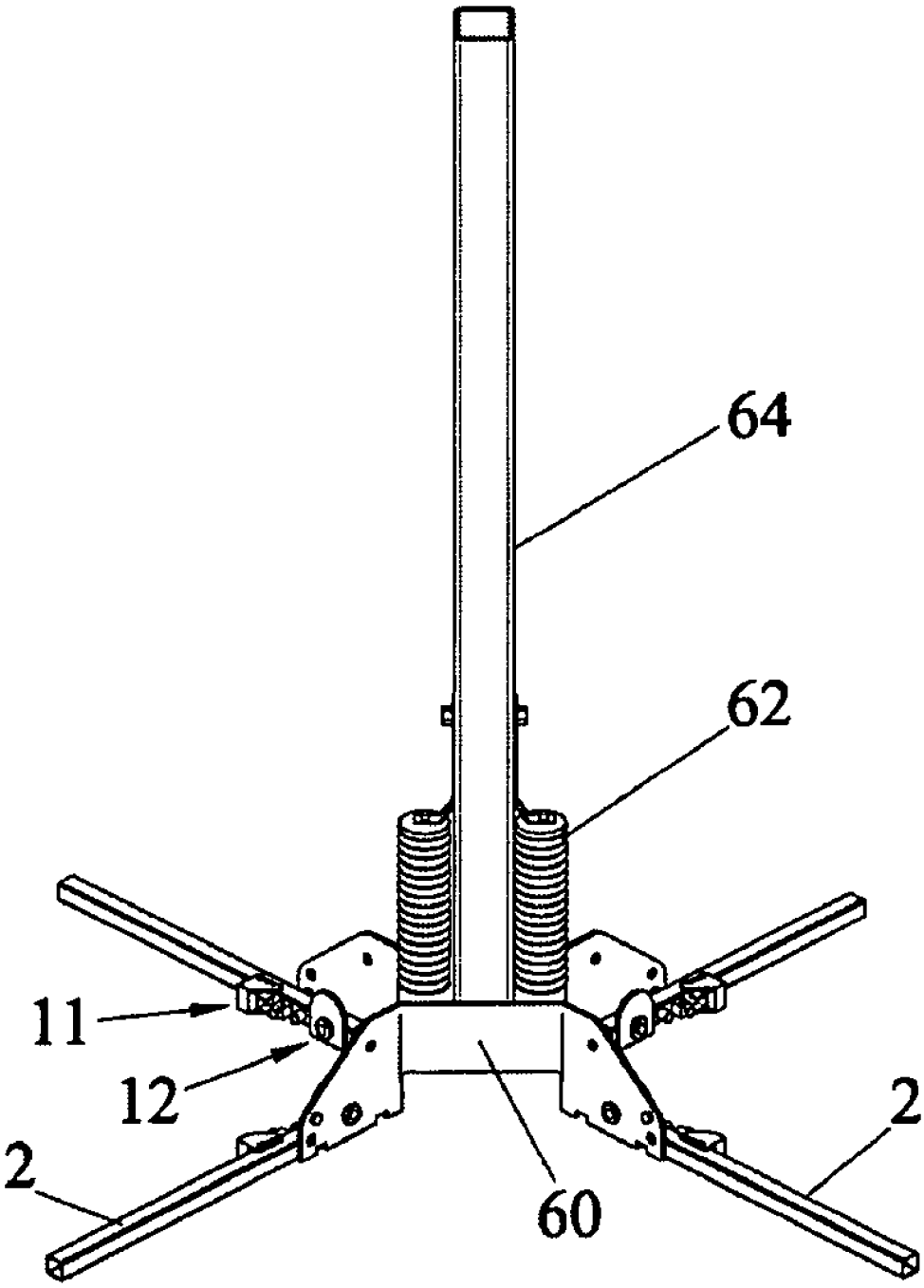
FIG. 10 is a perspective view of a sign supporting stand with an alternate base having a flexible shock absorbing sprung mast.

An alternative design for a base incorporating a flexible mast is shown in the perspective view in FIG. 10. This assembly incorporates the release mechanism of the present invention on legs 2 with an elongated base 60 and shock absorbing springs 62 connecting to the mast 64.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A dual-release locking system used in conjunction with a sign supporting stand comprising a mast and a plurality of upwardly foldable and radially extending legs pivoted at the bottom of the mast, each leg incorporated with an individual locking system, the locking system comprising:

a. a vertical plate member disposed along one side of the leg, a plurality of holes disposed on the plate member;

b. a first locking mechanism for engaging the leg to the plate member at various locking positions as the leg is rotated about the pivot, the first locking mechanism also disengaging from the leg at a locking position; comprising a locking pin transversely disposed within the leg such that both ends of the pin protrude out of the leg, the portion of the pin located inside the leg is fitted with a compression spring whereby when the pin is pulled back and released, it regains its original position; in order for the leg to engage the plate member at a desired position, the pin is slightly pulled back, the leg is slightly moved in the desired direction, and the pin is simultaneously released, so that the pin disengages from a locking position, abuts the plate member, and as the leg is rotated in the same direction, the pin automatically engages a hole at which point the leg is locked at the desired position;

c. a second locking mechanism for operating the first locking mechanism wherein the leg can be engaged to the plate member at the various locking positions; the second locking mechanism also disengages from the leg at a locking position; the second locking mechanism enabling the pin to be pulled backward, wherein the pin can disengage from one locking position and engage at another as the leg is rotated; and d. wherein the second locking mechanism comprises:

i. a disengaging member comprising first, second, and third panels, the third panel connecting the first and second panels so as to form an 'S' shaped structure, the first panel permanently attached to an end of the portion of the pin located within the leg, while the second panel is located outside the leg such that the pin is located between the pivot and the third panel;

ii. an engaging wedge-faced member fitted underneath the second panel; and iii. a sliding wedge-faced member disposed on the side of the leg such that the sliding wedge-faced member can slide along the side of the leg, the face of the sliding wedge-faced member matches with that of the first panel, wherein when the sliding wedge-faced member is slid against its counterpart, the disengaging member gradually moves backwards against the spring thereby pulling the pin along with it simultaneously and thereby performing the function of the first mechanism; the sliding wedge-faced member automatically slides back once the forward sliding force is withdrawn.

2. The locking system of claim 1, wherein the pin extends through the first panel centrally.

3. The locking system of claim 1, wherein the first, second, and third panels are mutually perpendicular.

4. The locking system of claim 1, wherein the first, second, and third panels are rectangular.

5. The locking system of claim 1, wherein the sliding wedge-faced member is designed to be operated by a longitudinal kicking action.

6. The locking system of claim 1, wherein the side of the sliding wedge-faced member which is opposite to the wedge face is connected to the leg by a tension spring whereby when the sliding wedge-faced member is slid against the engaging wedge-faced member and released, the sliding wedge-faced member slides back to its original position.

7. The locking system of claim 1, wherein the side of the sliding wedge-faced member that is opposite to its wedge face includes a foot-gripping surface.

8. The locking system of claim 1, wherein the second locking mechanism further comprises a supporting block and a reaction boss, the block abuts the side of the leg, the third panel of the disengaging member, and the boss, which is located on the same side of the leg and opposite to the third panel, the block in turn comprises a bore through which the pin is inserted into the transverse bore, the block is permanently connected to the pin wherein when the sliding wedge-faced member is slid against the first one, the disengaging member is gradually moved backwards while abutting the block, which is also gradually pulled backwards along with disengaging member and the pin, the block and the boss act as supports for counterbalancing the horizontal forces exerted by the sliding wedge-faced member on the engaging wedge-faced member, and the engaging wedge-faced member on the block respectively.

9. The locking system of claim 8, wherein the block is of a cuboidal shape.

* * * * *